US006926652B2

(12) United States Patent
Marchetti

(10) Patent No.: US 6,926,652 B2
(45) Date of Patent: Aug. 9, 2005

(54) DEVICE FOR STRAIGHTENING AND CLOSING THE REAR FLAP FOR SELF-DIMENSIONING MACHINE FOR CLOSING PARALLELEPIPED BOXES

(76) Inventor: Antonio Marchetti, Via Jacopo Palma, 17, Milan (IT), 20146

( * ) Notice: Subject to any disclaimer, the term of this patent is extended or adjusted under 35 U.S.C. 154(b) by 0 days.

(21) Appl. No.: 10/713,225

(22) Filed: Nov. 17, 2003

(65) Prior Publication Data

US 2004/0097356 A1 May 20, 2004

(30) Foreign Application Priority Data

Nov. 15, 2002 (IT) ..... MI2002A2430

(51) Int. Cl.[7] ..... B31B 1/48

(52) U.S. Cl. ..... 493/80; 493/70; 493/81; 493/23

(58) Field of Search ..... 493/80, 70, 81, 493/127, 151, 156, 13, 23; 53/377.2, 136.4, 377.3

(56) References Cited

U.S. PATENT DOCUMENTS 3,267,640 A * 8/1966 Romney et al. ..... 53/75
3,775,937 A * 12/1973 Devan et al. ..... 53/75
3,894,380 A * 7/1975 Poulsen ..... 53/75
3,981,122 A * 9/1976 Johnson ..... 53/376.5
4,041,675 A * 8/1977 Loveland et al. ..... 53/76
4,218,862 A 8/1980 Marchetti ..... 53/374
4,317,320 A * 3/1982 Nigrelli ..... 53/377.2
4,722,165 A 2/1988 Marchetti ..... 53/76
5,115,625 A * 5/1992 Barbulesco et al. ..... 53/467
5,685,814 A * 11/1997 Le ..... 493/117
5,839,254 A 11/1998 Chen ..... 53/377

* cited by examiner

*Primary Examiner*—Sameh H. Tawfik
(74) *Attorney, Agent, or Firm*—Jacobson Holman PLLC

(57) ABSTRACT

A device for closing the rear flap in a self-dimensioning machine for closing the upper flaps of parallelepiped boxes of the type including a base with support surface for the boxes, a couple of drive belts that can be motorized placed at the two sides of the support surface and that can be brought close to each other to make a drive engagement with the sides of the boxes and a head above the support surface, that carries devices for closing the front, rear and side flaps of the boxes and can be commanded to descend from a rest position to engage the above-mentioned devices with the upper flaps of the boxes and to close them. The device for closing the rear flap includes a rod for straightening the rear flap, that is pivoted on said the head and can be commanded to rotate from a substantially horizontal rest position to a vertical working position and to translate in the same direction as the boxes advancement to carry out the straightening of the rear flap, a touching group vertically mobile that can be commanded to descend towards the support surface up to a position depending on the height of the box and a lever pivoted on the touching group downstream from the straightening rod and flexibly kept in an angular position suitable for meeting with its inclined surface, during the descent of the touching group, the straightened rear flap and thus to cause the movement of the flap in a closing position.

5 Claims, 20 Drawing Sheets

DEVICE FOR STRAIGHTENING AND CLOSING THE REAR FLAP FOR SELF-DIMENSIONING MACHINE FOR CLOSING PARALLELEPIPED BOXES

FIELD OF THE INVENTION

The present invention refers to a device for straightening and closing the rear flap for a self-dimensioning machine for closing parallelepiped boxes.

BACKROUND OF THE INVENTION

Machines of various kinds for closing the upper flaps of cardboard parallelepiped boxes before applying adhesive sealing tape are known.

In particular so-called "self-dimensioning" machines are known, that accept boxes of various widths and heights, automatically adapting their operative parts to the dimensions of the box.

More in particular self-dimensioning machines are known that comprise a base with support surface for resting the boxes on, a couple of drive belts that can be motorized placed at the two sides of said support surface and that can be brought close to each other to make a drive engagement with the sides of the boxes and a head above said support surface, that carries suitable devices for closing the front, rear and side flaps of the boxes and can be commanded to descend to a rest position for engaging the above-mentioned devices with the upper flaps of the boxes and thus providing for their closure. Suitable mechanical or photocell or other sensors provide for the automation of the various movements in accordance with the position and the dimensions of the boxes.

One problem encountered by the machines of this type is represented by the closing of the rear flap, that requires a device to take the flap, often partially folded outwards, from behind the flap itself and, after having straightened it, determines the closing of the flap with substantially contrary rotary movement.

SUMMARY OF THE INVENTION

In view of the state of the art the object of the present invention is to make a device for closing the rear flap for self-dimensioning machines of the type described above, that permits to carry out in a simple and efficient way first the straightening the flap from a position partially folded outwards and then the rotation of the same flap for reaching the closing position.

In accordance with the invention this object is achieved with a device for closing the rear flap in a self-dimensioning machine for closing the upper flaps of parallelepiped boxes of the type comprising a base with surface for supporting the boxes, a couple of drive belts that can be motorised placed at the two sides of said support surface and that can be brought close to each other to make a drive engagement with the sides of the boxes, a head above said support surface, that carries devices for closing the front, rear and side flaps of the boxes and can be commanded to descend from a rest position to engage the above-mentioned devices with the upper flaps of the boxes and provide for their closure, and means for detecting the position and the dimensions of the boxes for the automatic command of the movements of the machine, characterised in that it comprises a rod for straightening the rear flap, that is pivoted on said head and can be commanded to rotate from a substantially horizontal rest position to a vertical working position and to translate in the same feed direction of the boxes to carry out the straightening of the rear flap, a vertically mobile touching group that can be commanded to descend towards said support surface up to a position depending on the height of the box and a lever pivoted on said touching group downstream from said straightening rod and flexibly kept in an angular rest position suited to meeting with one of its inclined planes, during the descent of the touching group, the straightened rear flap and thus to cause the movement of the flap to the closing position.

In this manner, whatever the height of the box is, first the rear flap is straightened from an eventual position folded outwards and then it is folded to the closing position. Thus the certainty of effective and complete closing of the box is obtained, whatever its height is.

In particular it is to be noted that the closing movement of the rear flap is not imposed by a power command, but it is simply the result of the flap-closing lever meeting the flap itself during the descent of the touching group.

BRIEF DESCRIPTION OF THE DRAWINGS

An embodiment of the present invention is illustrated as non-limiting example in the enclosed drawings, in which.

DETAILED DESCRIPTION OF THE PREFERRED EMBODIMENTS

Figure 3:
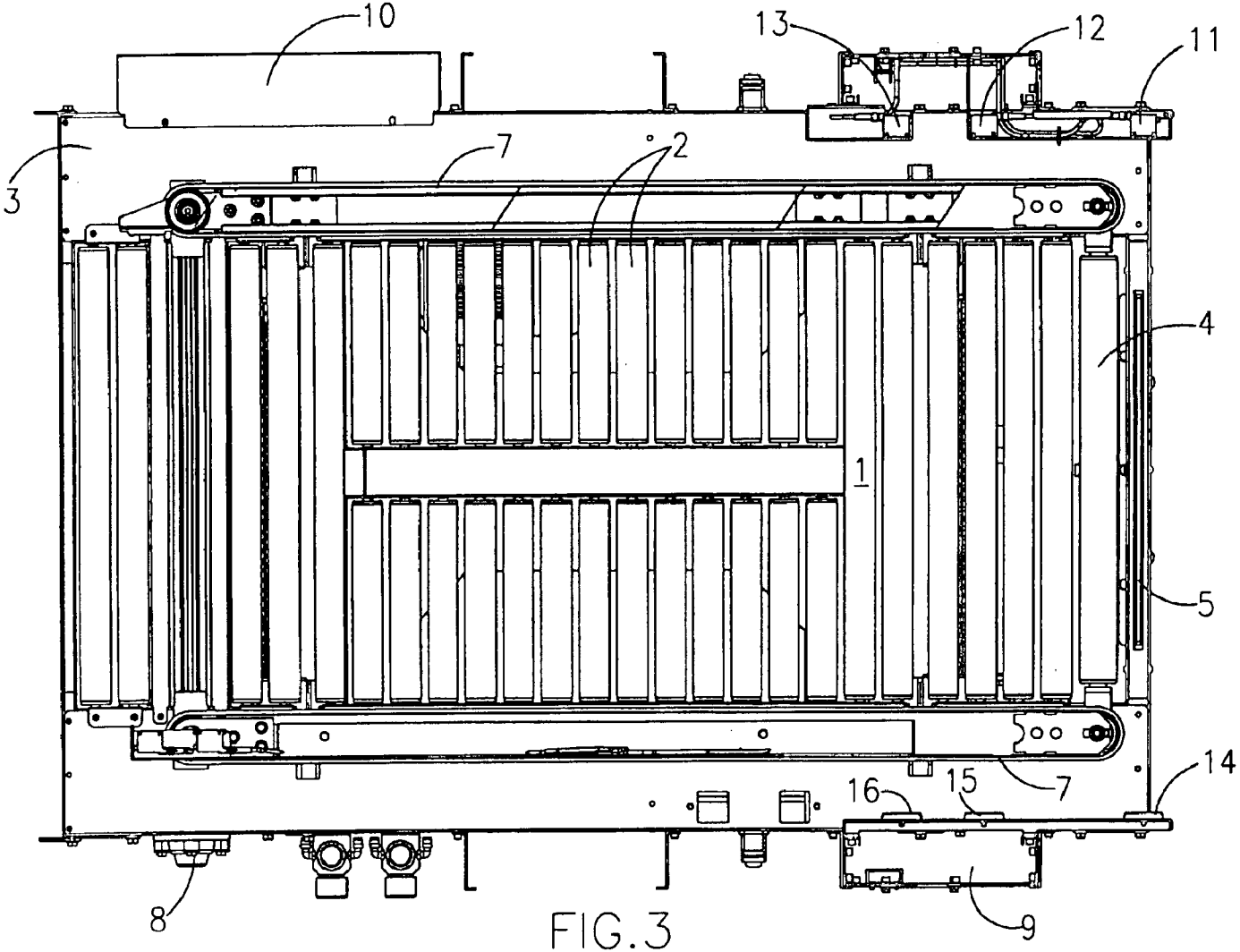
FIG. 3 shows the same machine, again in said awaiting position, sectioned in a plan above the feed surface of the boxes.

The machine shown in the drawings is provided for the straightening and the closing of the end flaps, front and rear, of parallelepiped boxes fed in succession onto a support surface 1 formed by a succession of idle rollers 2 supported by a base frame 3 (FIG. 3).

The succession of idle rollers 2 is preceded, in the feed direction of the boxes (from right to left looking at FIG. 1), by a motorised roller 4 in turn preceded by a stopping blade 5, that can be raised and lowered by activating a pneumatic cylinder 6.

At the two sides of the support surface 1 two chain conveyors 7 are provided that can be motorized thanks to an electric motor 8, and that can be brought closer to each other or further away from each other by means of the use of any known device.

Figure 1:
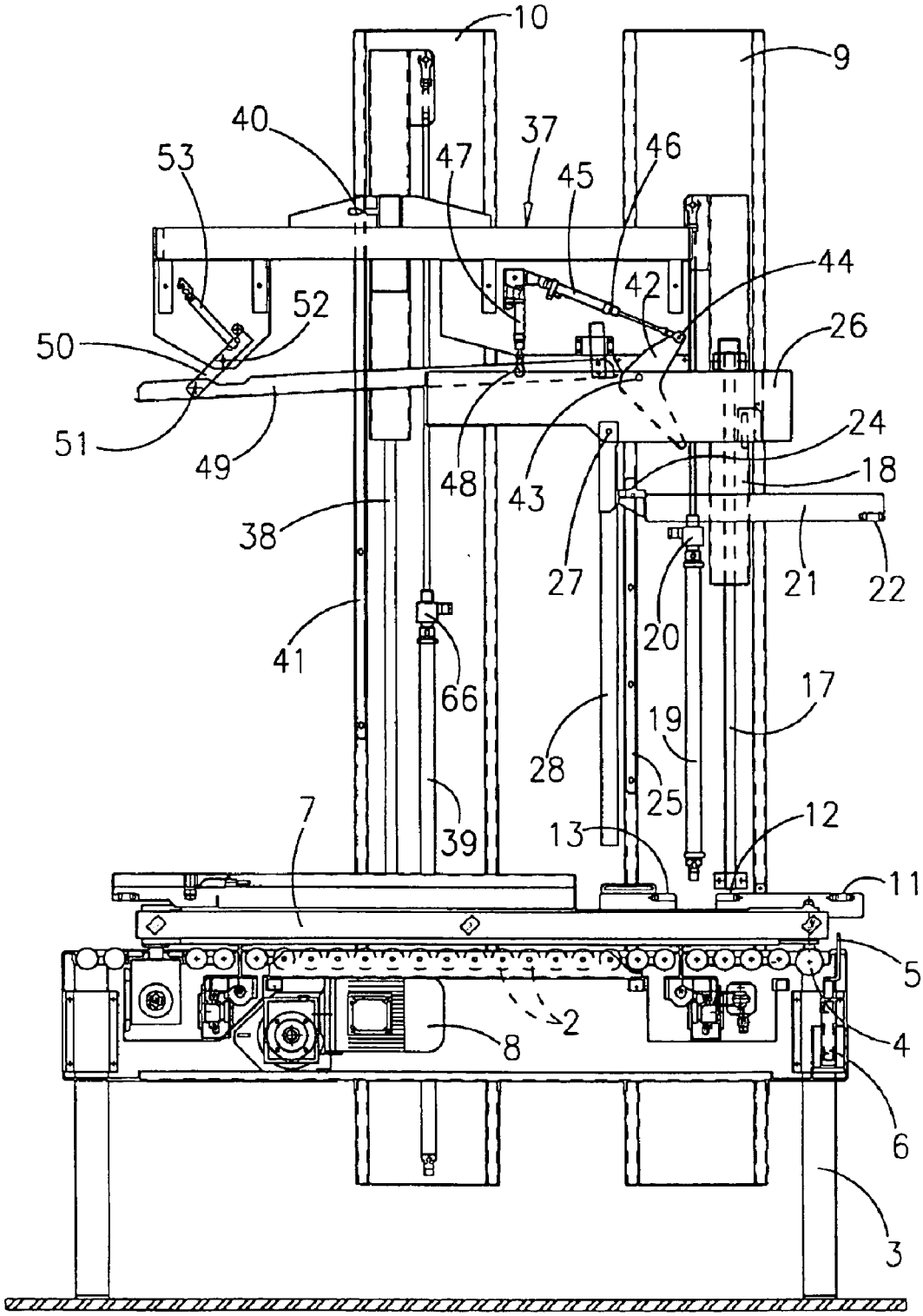
FIG. 1 shows in a side view, in the position awaiting a box, a machine for closing parallelepiped boxes that uses a device for straightening and closing the rear flap in accordance with the present invention.
Figure 2:
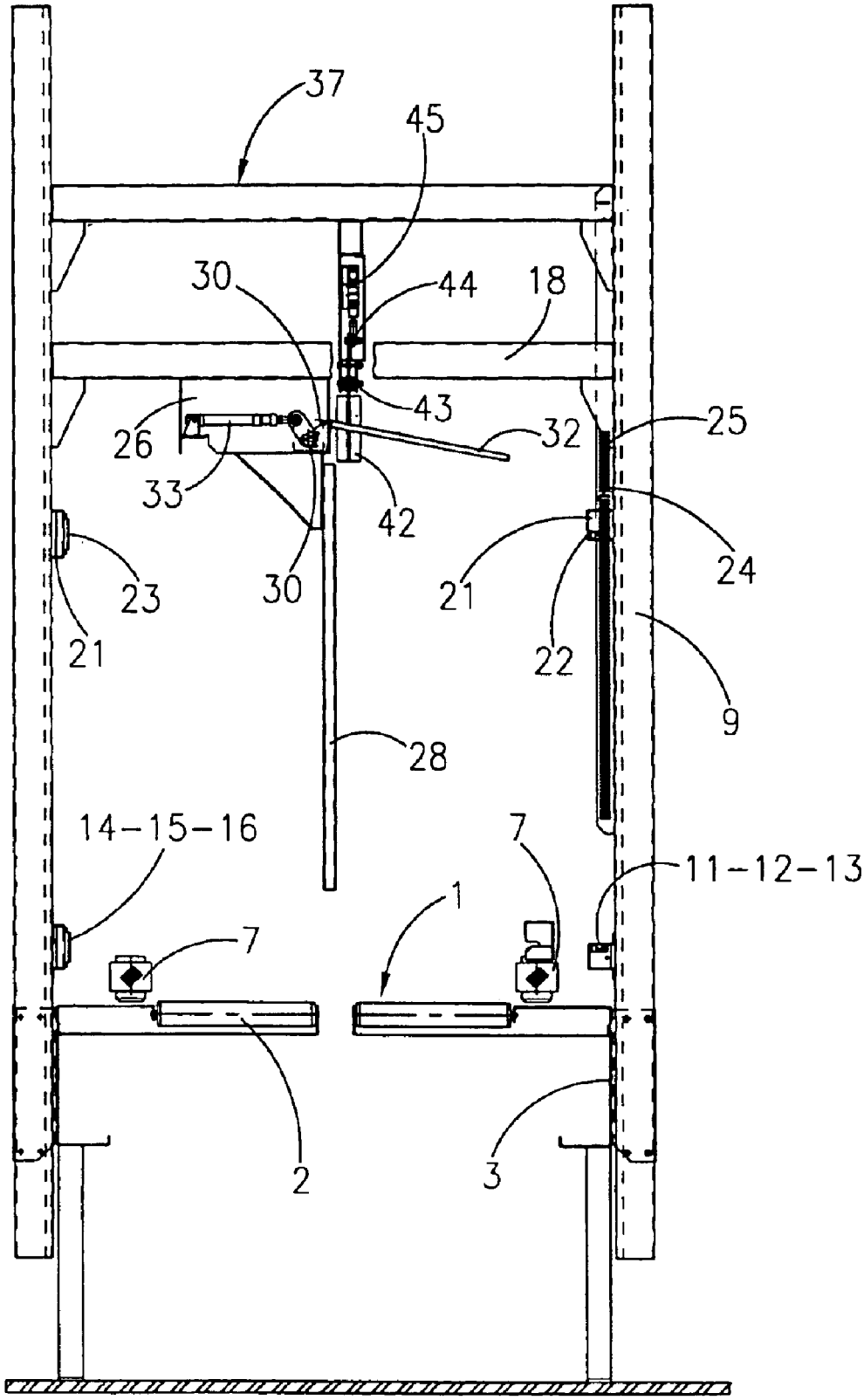
FIG. 2 shows the same machine in a front view, again in said awaiting position.

From the base frame 3 two fixed portals 9 and 10 extend upwards, the first of which supports, on one part, a succession of photocells 11, 12 and 13 and, on the other side, a corresponding succession of mirrors 14, 15 and 16 capable of reflecting backwards the light rays emitted by the above-mentioned photocells (FIGS. 1 and 2).

Figure 20:
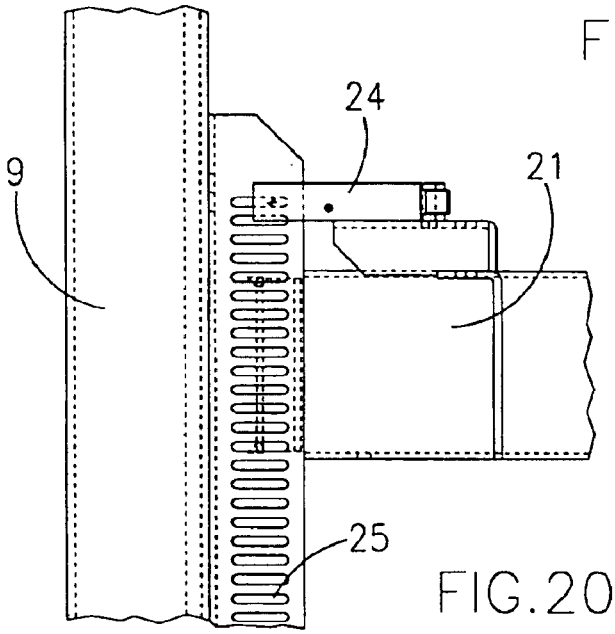

The fixed portal 9 also supports along its side uprights a couple of guide rods 17 for the vertical sliding of a mobile portal 18, that can be raised and lowered by means of a pneumatic cylinder 19 placed along one of its above-mentioned uprights. A brake group 20 is provided for, whose task is to stop the descent of the mobile portal 18 when required. A couple of bars 21 is fixed to the mobile portal 18, and bear photocell 22 and a facing mirror 23. A notch reader 24 is also fixed to one of the two bars 21 and cooperates with a holed band 25 that extends vertically along one of the uprights of the fixed portal 9 (FIGS. 1 and 2). The constructive details of the notch reader 24 and the holed band 25 are shown in enlarged scale in FIG. 20.

Figure 22:
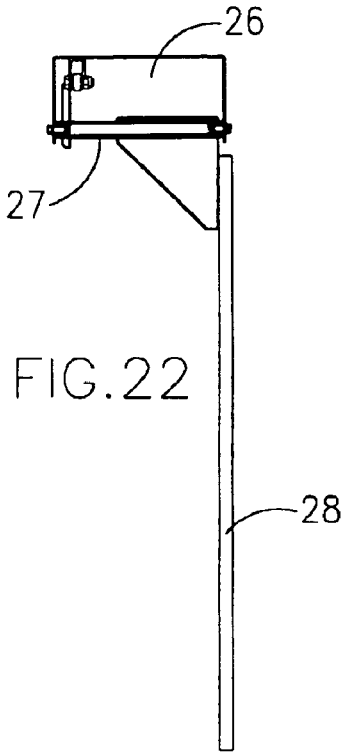
FIGS. 20–24 show enlarged details of several mechanisms comprised in the machine of the previous figures.
Figure 21:
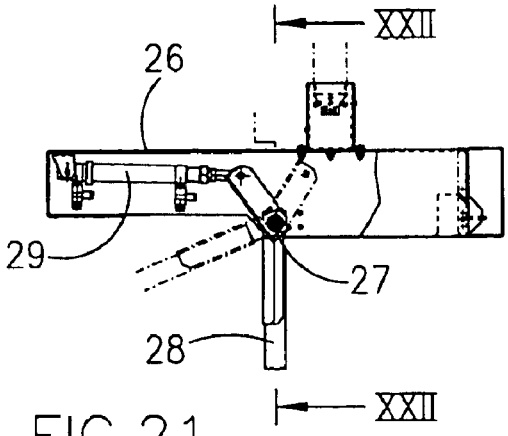

The mobile portal 18 also bears centrally a head or trolley hollow internally 26, on which a rod 28 is pivoted in pin 27 destined to straightening and folding the front flap of the boxes. The rod 28 is clutched by means of a pneumatic cylinder 29 fitted with pressure regulator (not shown), that shows resistance to the rotation of the rod 28 in relation to the normal vertical rest position that is illustrated in FIGS. 1 and 2. The constructive details of the pin 27, of the rod 28 and of the cylinder 29 are shown in enlarged scale in FIGS. 21 and 22, where FIG. 22 is a section view according to the line XXII—XXII of FIG. 21.

Figure 13:
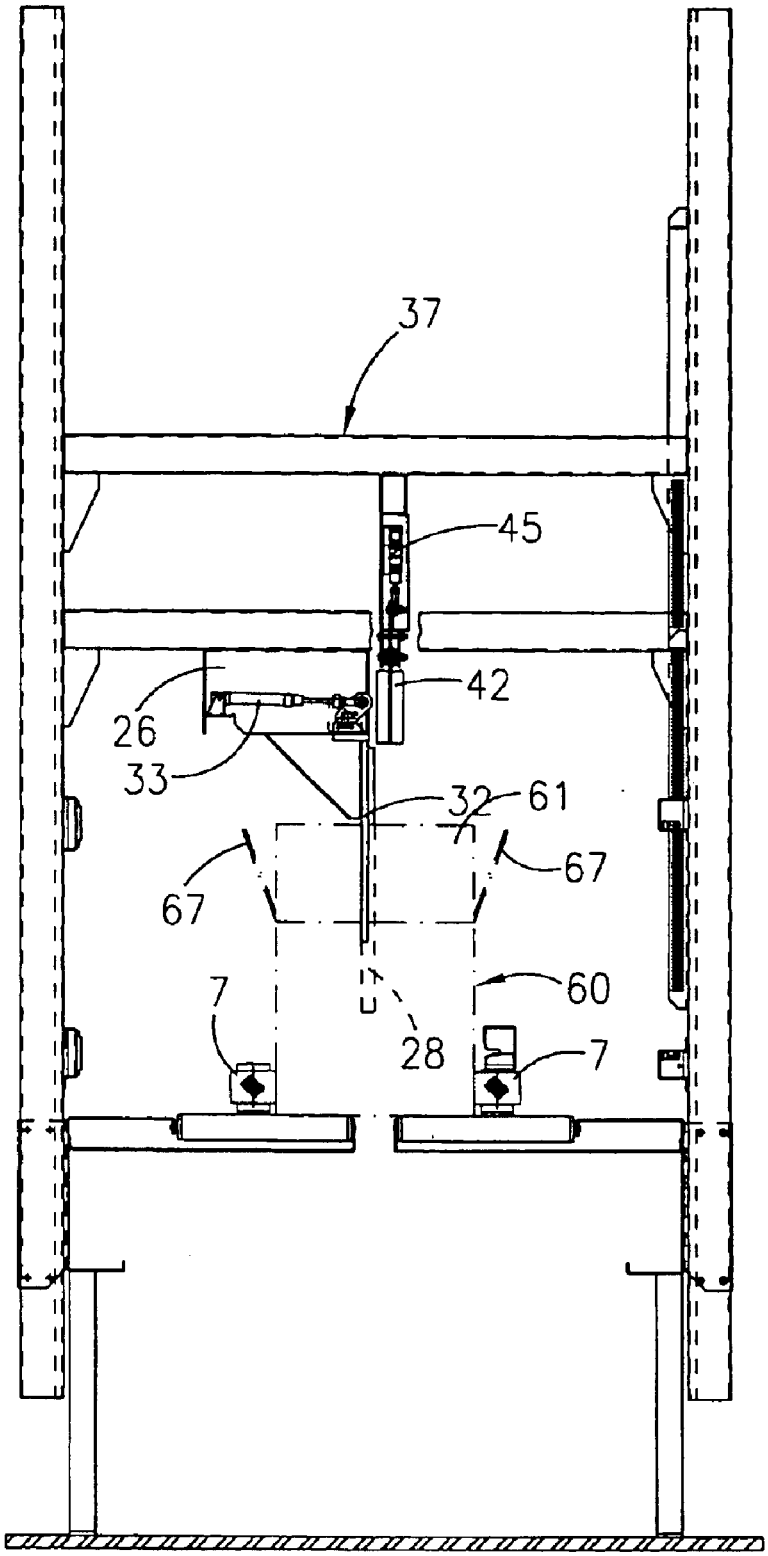
FIG. 13 shows the machine in a front view in the working position of FIG. 11.
Figure 14:
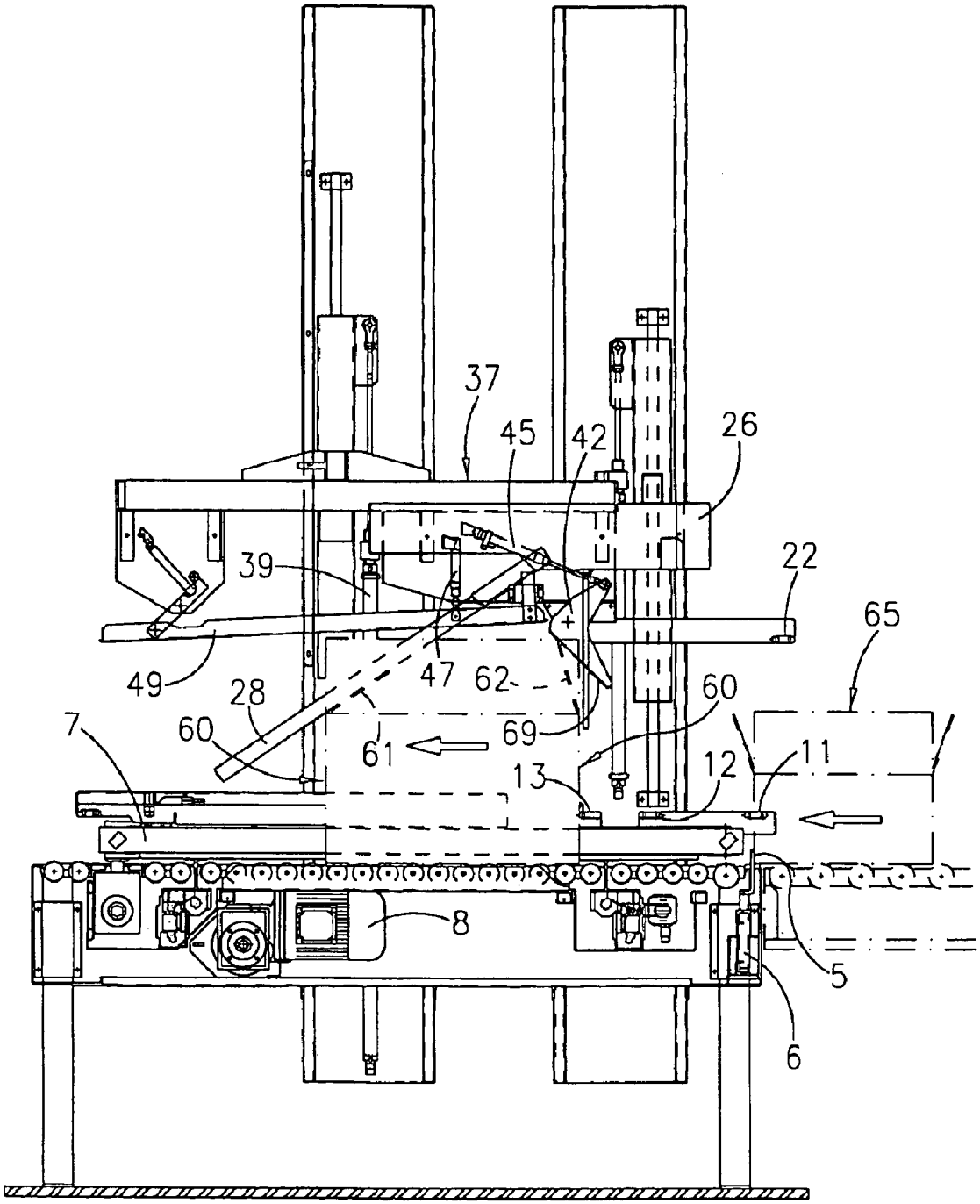
FIG. 14 shows the machine in a side view at the beginning of the closing movement of the rear flap of the box.
Figure 23:
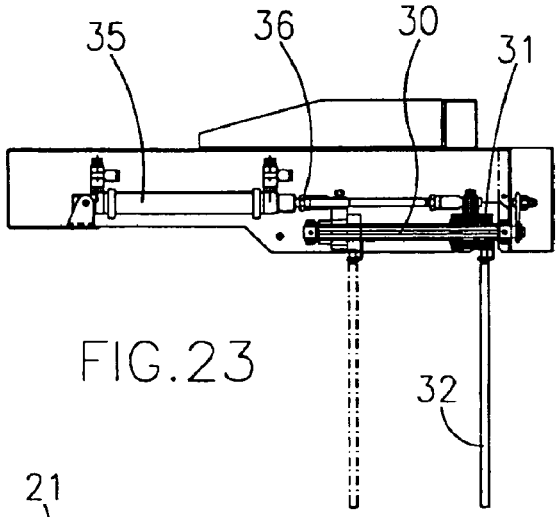
Figure 24:
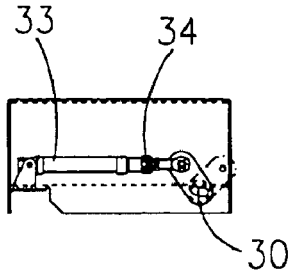

The trolley 26 also bears, sliding on a horizontal splined pin 30 thanks to a splined bushing 31, a rod 32 destined to straightening and folding the rear flap of the boxes. The splined pin 30, and with it the bushing 31 and the rod 32, is commanded to rotate from the nearly horizontal position of FIG. 2 to the vertical position of FIGS. 12 and 13 by a pneumatic cylinder 33 to which an end of stroke sensor 34 is associated, while the translation of the bushing 31, and thus of the rod 32, along the splined shaft 30 from the backward position of FIG. 1 to the forward position of FIG. 14 is commanded by a pneumatic cylinder 35 to which an end of stroke sensor 36 is associated. The constructive details of the splined pin 30, of the bushing 31, of the rod 32 and of the cylinders 33 and 35 with relative sensors 34 and 36 are shown in enlarged scale in FIGS. 23 and 24, where FIG. 24 is a right view in relation to FIG. 23.

The fixed portal 10 bears in turn a touching group 37, that can be moved vertically along guide rods 38 by means of a pneumatic cylinder 39 with brake group 66 (FIG. 1) and bears a notch reader 40 cooperating with a vertical fixed holed band 41. The notch reader 40 and the holed band 41 are all similar to the reader 24 and to the holed band 25 shown in FIG. 20.

The touching group 37 also bears an L lever 42, pivoted in 43 (FIG. 1), whose task is to carry out the closing folding of the rear flap of the boxes and is connected by means of a pin joint 44 to the stem of a pneumatic cylinder 45 fitted with an end of stroke sensor 46.

Finally a central longitudinal guide 49 is pivoted at pivot point 68 on the touching group 37, and is also connected at the rear to the same touching group 37 by means of a connecting rod 50 pivoted in 51 and 52, with which a spring 53 reacts. The guide 49 is normally in a slightly inclined position in relation to the horizontal one (FIG. 1), but can be moved to a horizontal position (FIG. 18) by activating a pneumatic cylinder 47 to which it is connected by means of a pin joint 48.

Figure 4:
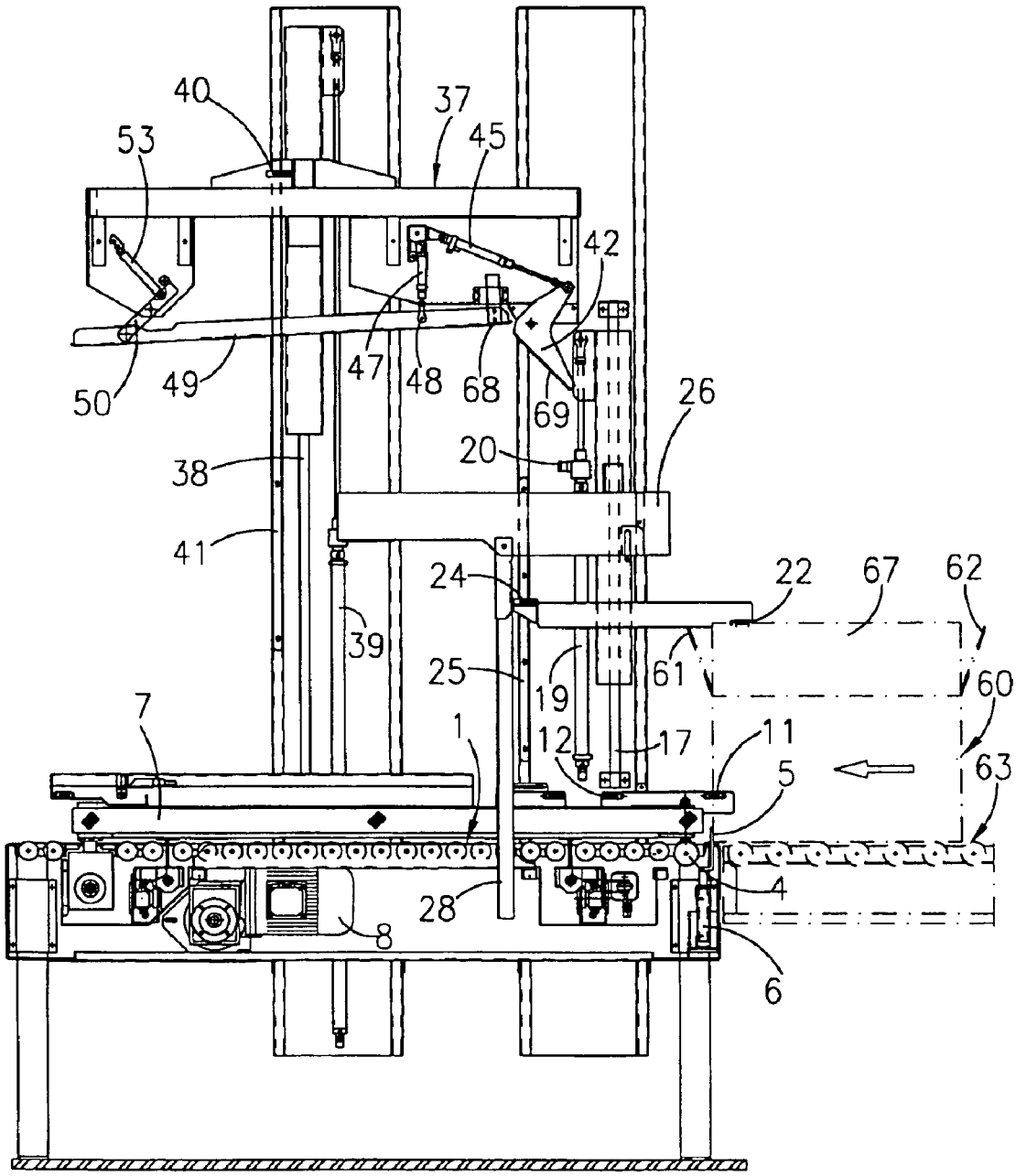
FIG. 4 shows the machine in a side view at the moment the box enters.

Through effect of the structure described above the machine illustrated in the drawings operates in the following manner on a parallelepiped cardboard box 60, which is presented with upper flaps open, and in particular with front flap 61 and rear flap 62 partially rotated outwards as shown in FIG. 4, on a sliding surface 63 placed in continuation of the support surface 1.

Figure 5:
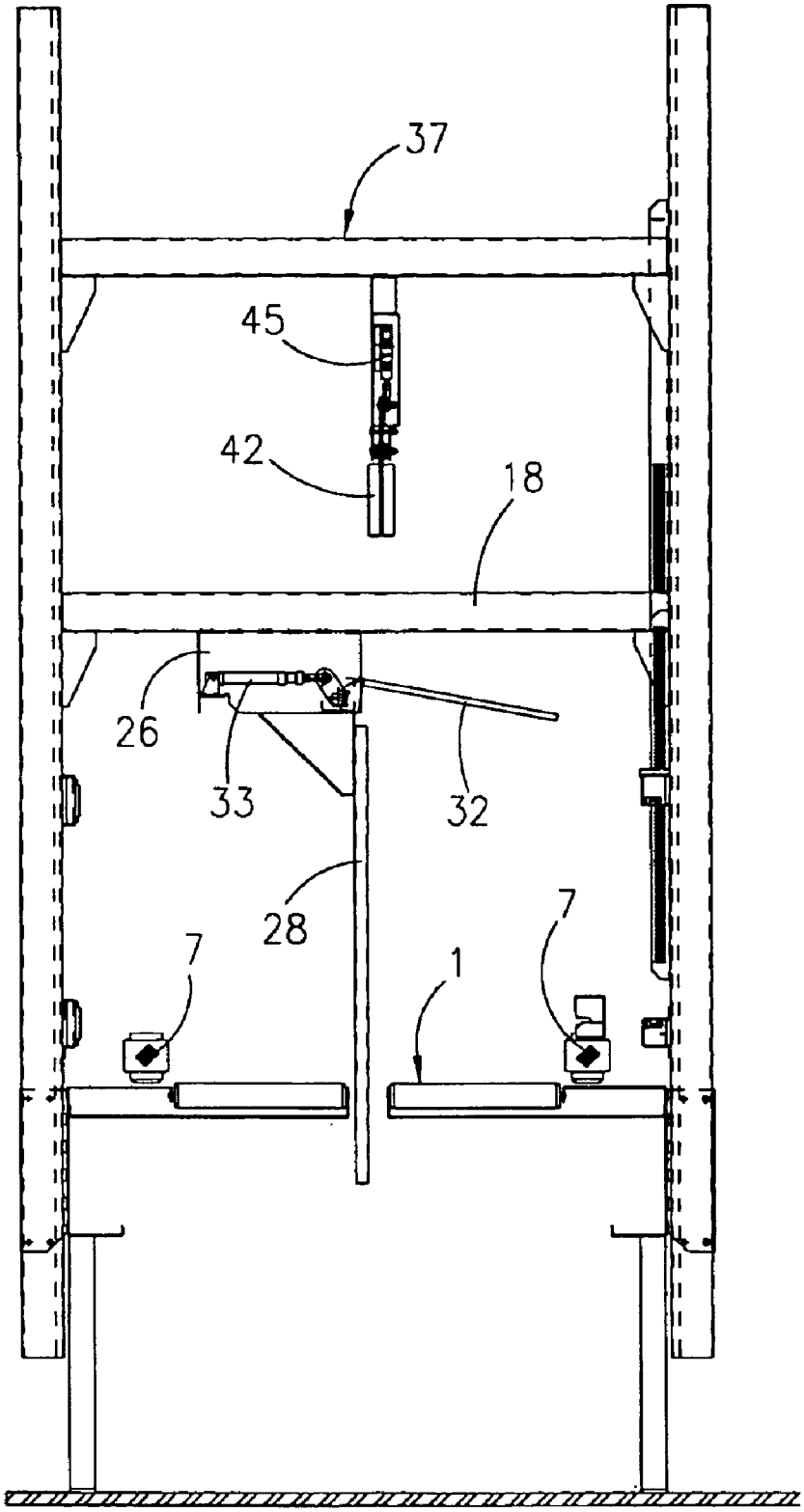
FIG. 5 shows the machine in a front view in the working position of FIG. 4.

The first phase of the working cycle of the machine shown in the drawings is illustrated in FIGS. 4 and 5. The box 60 coming from the sliding surface 63 arrives at the entrance of the machine, where it stops against the stop 5, and activates the photocell 11, whose command starts the cycle.

The activation of the photocell 11 starts off the detection of the box height. With the photocell 22 free, the trolley 26 carrying the photocell 22 starts the descent, guided by the rods 17 and commanded by the pneumatic cylinder 19, until the photocell 22 is activated. During the descent of the trolley 26 the notch reader 24, in one with the trolley 26, detects by means of the holed band 25 the height position of the trolley itself. When the photocell 22 detects the box 60, the descent of the trolley 26 is blocked by means of the activation of the brake group 20.

Figure 6:
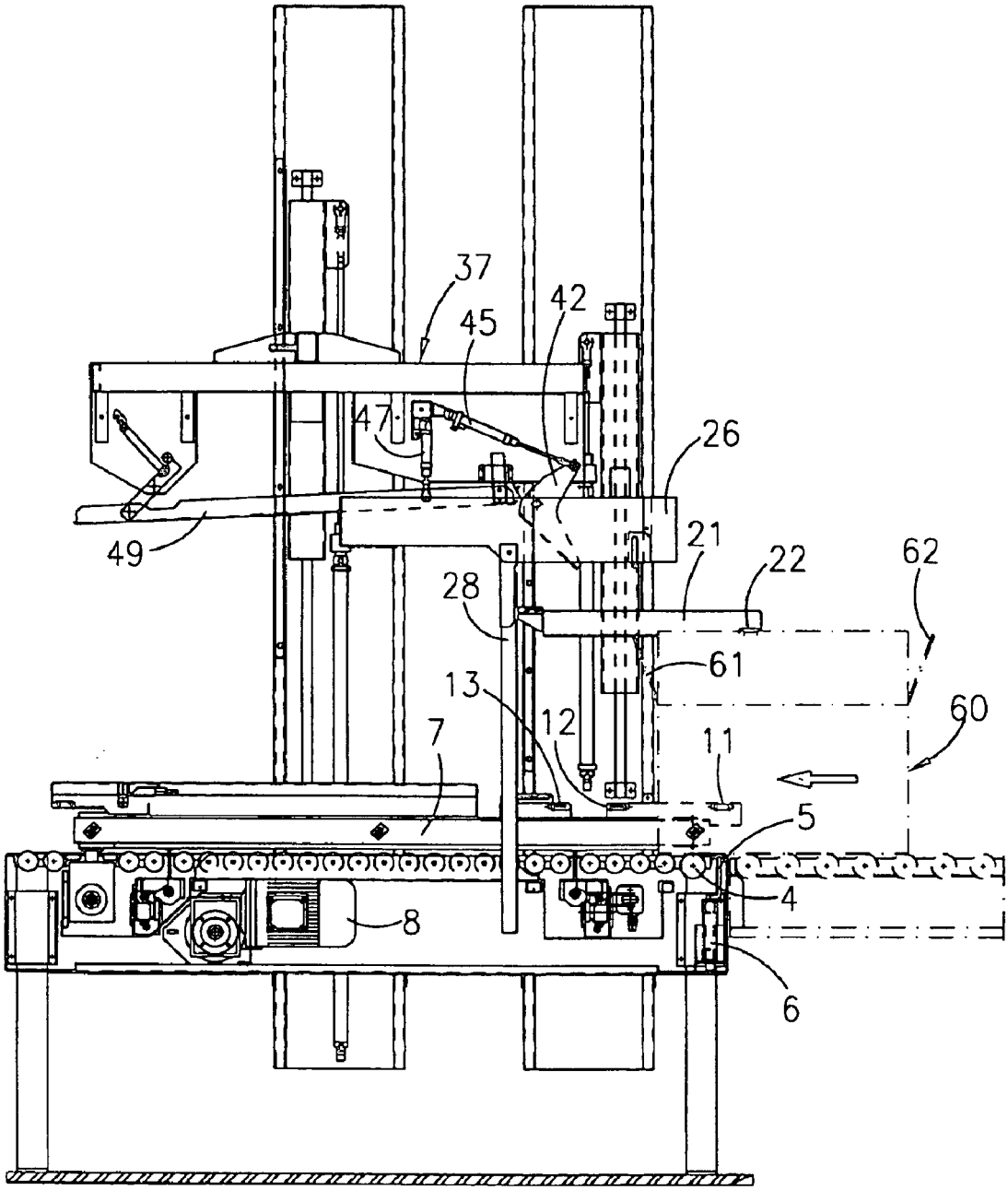
FIG. 6 shows the machine in a side view immediately after the entrance of the box.
Figure 7:
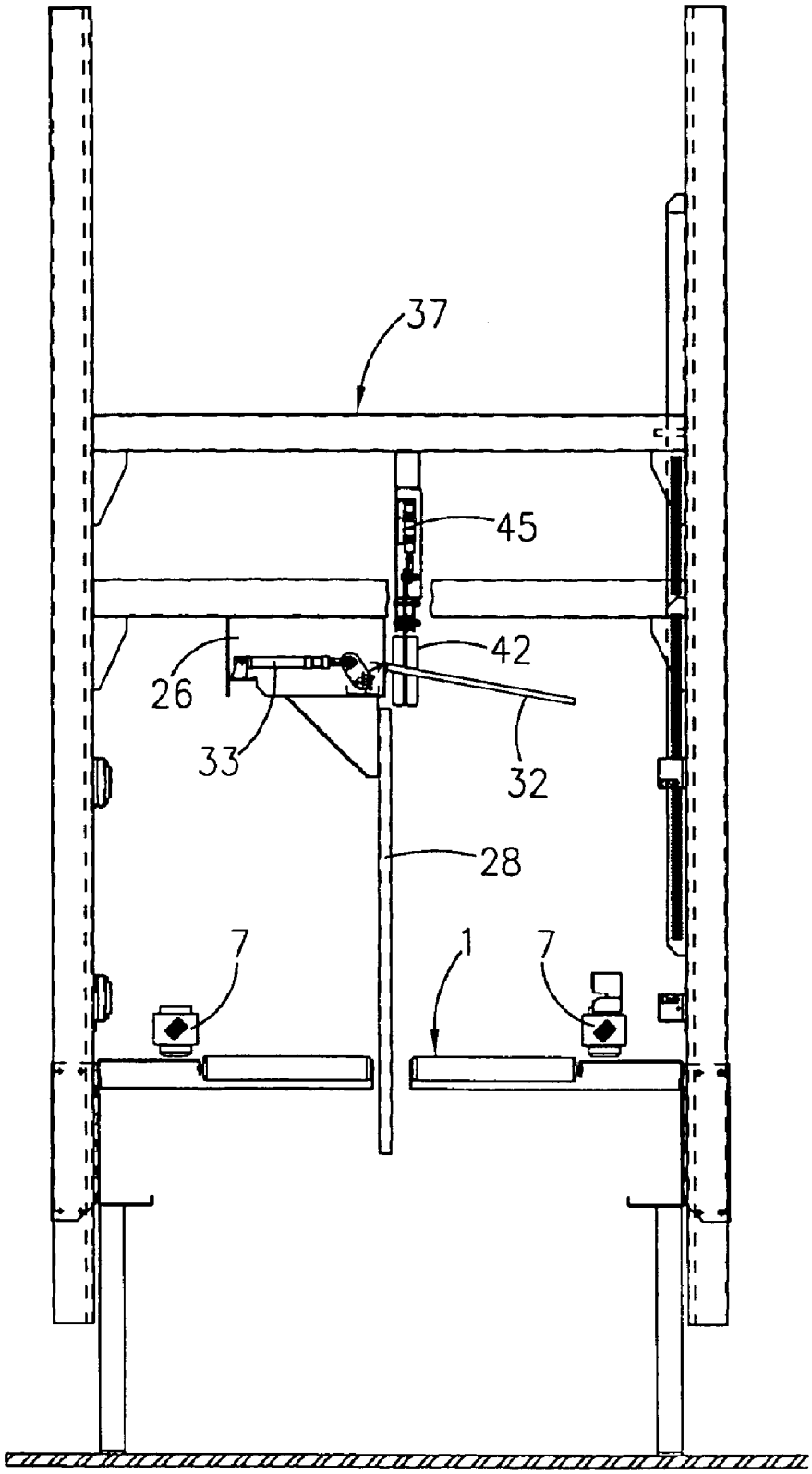
FIG. 7 shows the machine in a front view in the working position of FIG. 6.
Figure 8:
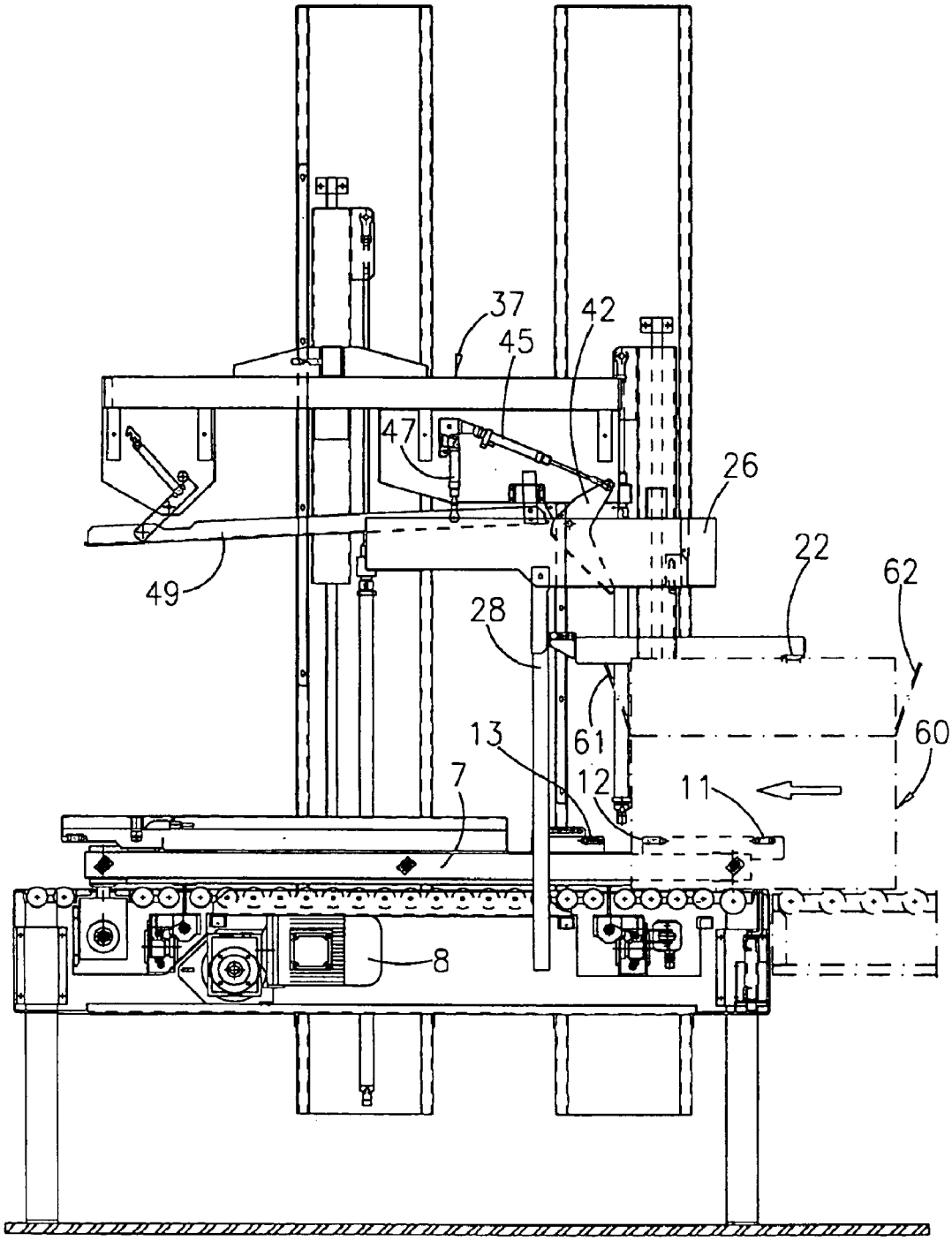
FIG. 8 shows the machine in a side view in a successive phase of feed of the box.
Figure 9:
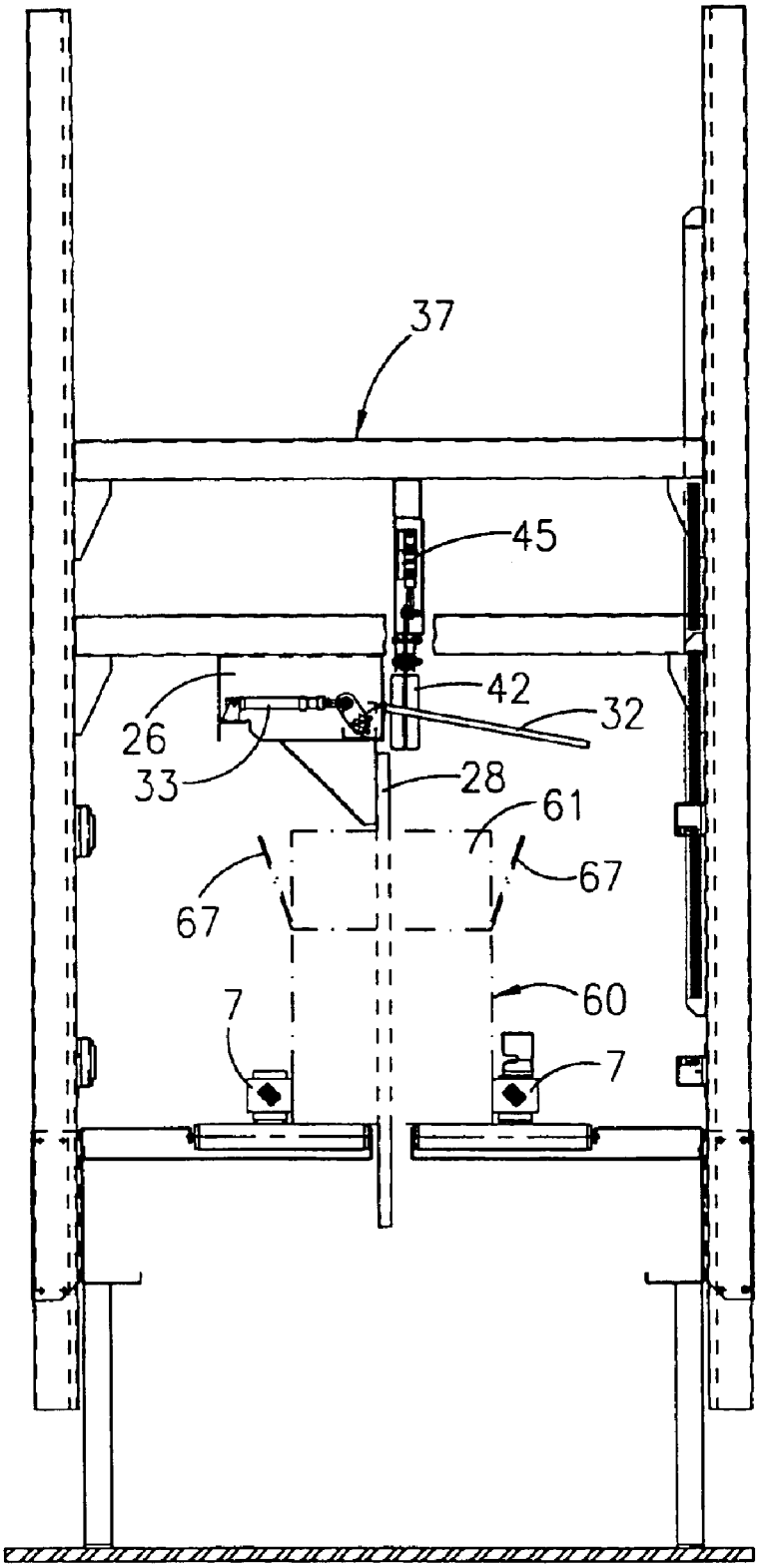
FIG. 9 shows the machine in a front view in the working position of FIG. 8.

The activation of the photocell 22 commands the entrance into the machine of the box 60 lowering the stop 5, activated by the cylinder 6, and starting the motorized roller 4 and the motor 8. At the same time the touching group 37 starts getting closer to the box 60 under the command of the pneumatic cylinder 39 and with the guide of the rods 38 (FIGS. 6 and 7). By means of the notch reader 24 and the relative holed band 25 the height at which the trolley 26 is stopped is known. The notch reader 40 with respective holed band 41 enables the position of the touching group 37 to be controlled and temporarily stops the descent at about 10 cm from the box; this is done to make the machine cycle faster. The box 60 advances, driven by the motorized roller 4, until the photocell 12 (FIG. 8) is activated.

The activation of the photocell 12 commands the closing of the driving belts 7, which, coming into contact with the sides of the box 60 and being the same in movement by means of the motor 8, drive the same inside the machine.

Figure 10:
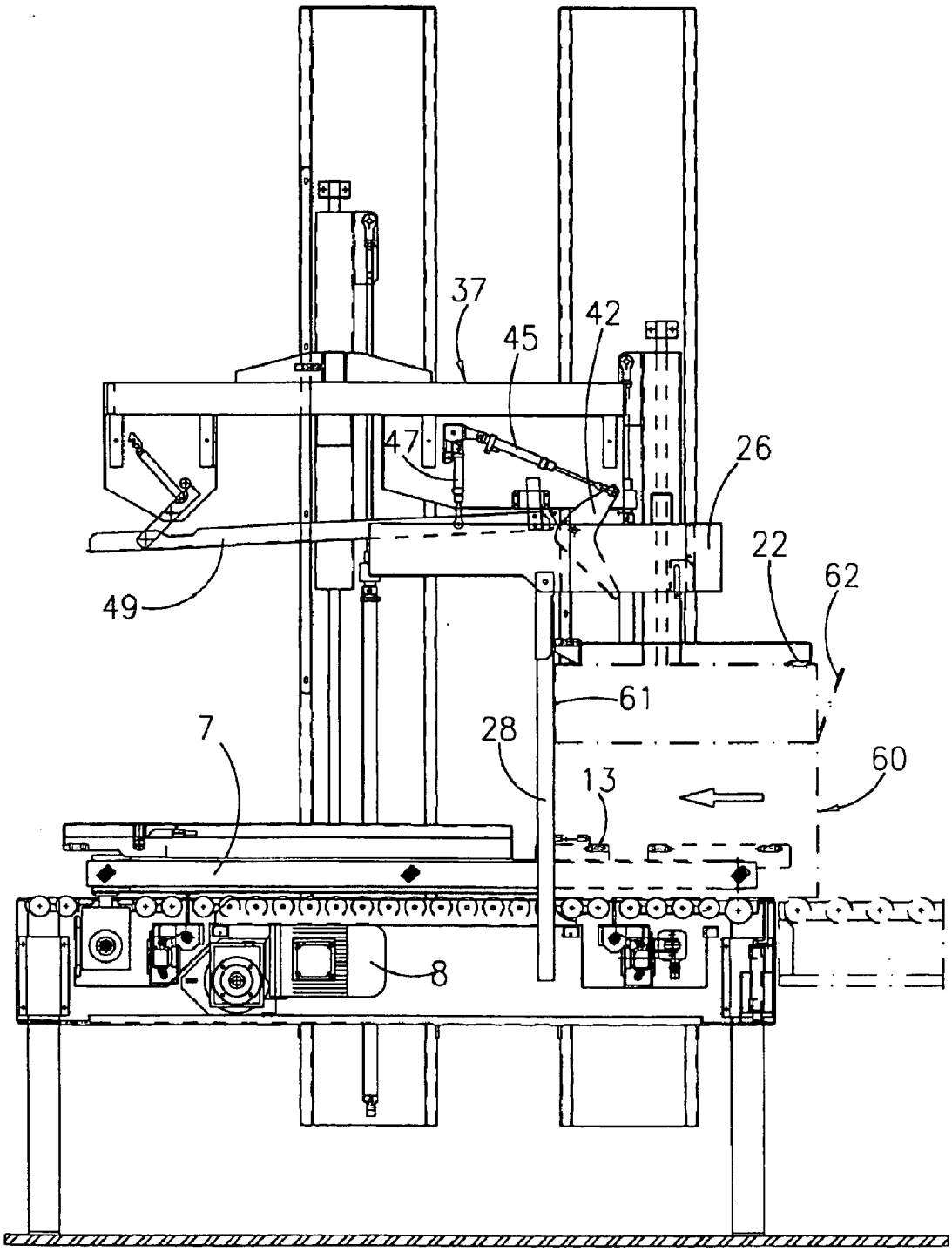
FIG. 10 shows the machine in a side view at the moment the front flap of the box is straightened.
Figure 11:
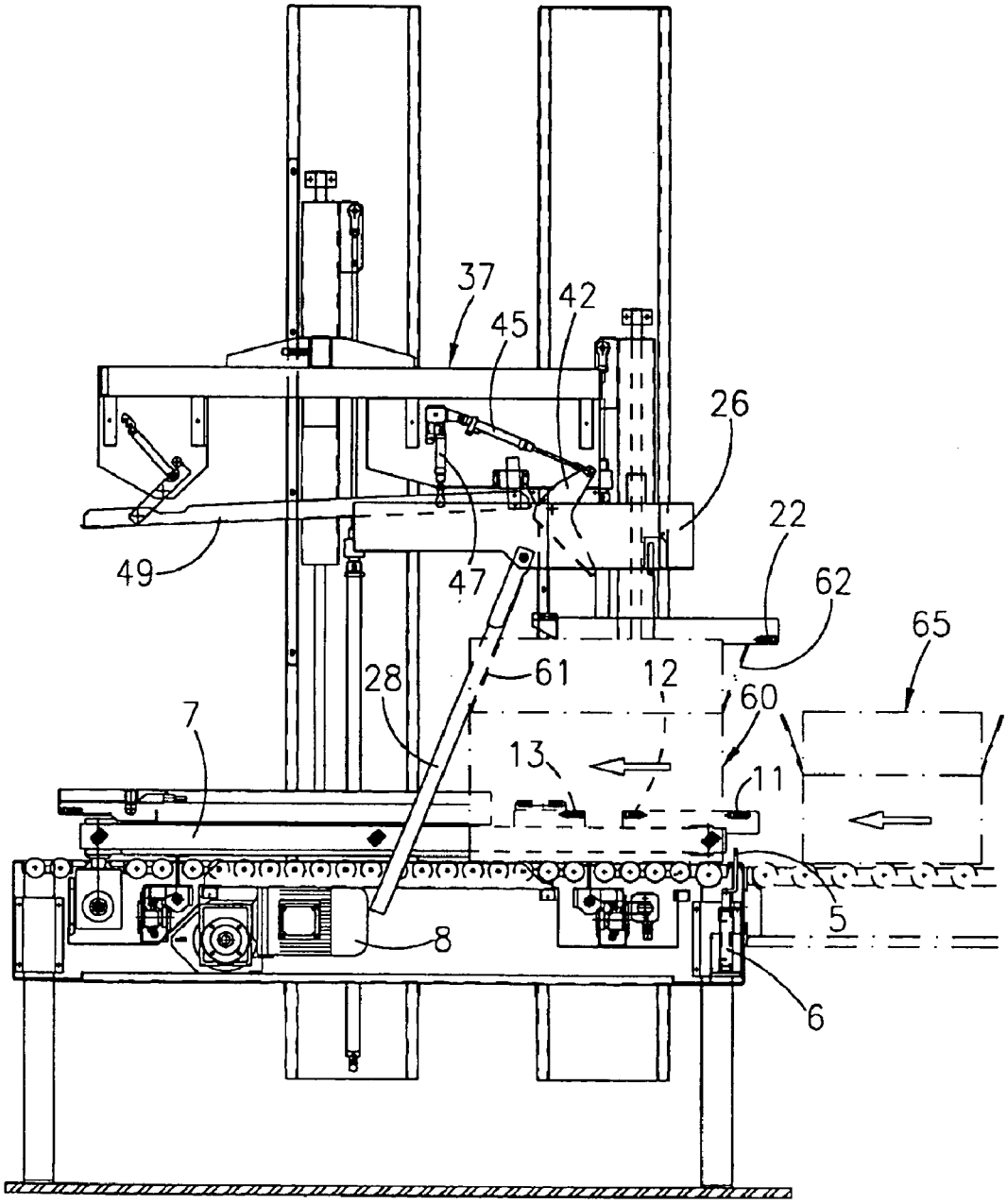
FIG. 11 shows the machine in a side view at the moment the closing movement of the front flap of the box starts.
Figure 12:
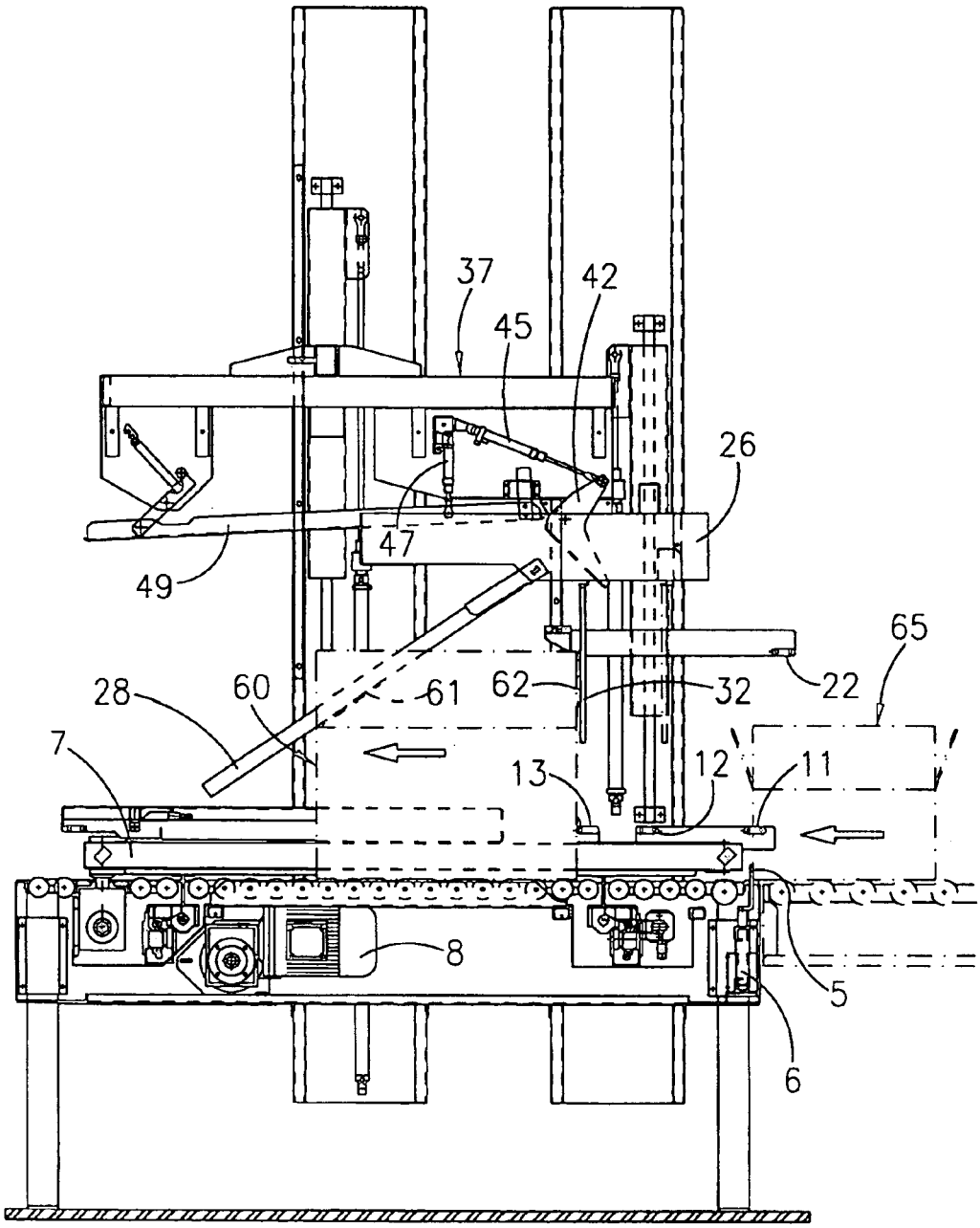
FIG. 12 shows the machine in a side view at the moment the rear flap of the box is straightened.

During its advancement the box 60 activates the photocell 13, which in this phase does not activate any function, and comes into contact with the rod 28, which at first straightens the front flap 61 of the box (FIG. 10) and successively starts folding it inwards (FIG. 11). During rotation, the rod 28 extends the cylinder 29 (FIG. 21), which opposes resistance, can be regulated by means of special pressure regulator, that enables the front flap of boxes of different hardness to be folded. During the advancement the box 60 frees the photocell 11, which by means of the cylinder 6 commands the raising of the stop 5 in order to block the entrance of the successive box 65 into the machine (FIG. 12).

The box 60 continues advancing until it frees the photocell 13, which commands the stop of the motor 8 and therefore of the box 60. At this point the front flap 61 of the box 60 has been almost completely folded inwards and at the same time when the box stops the straightening the rear flap 62 starts up. The rod 32 destined to straightening the rear flap 62 is activated by the pneumatic cylinder 33 so as to go to the almost horizontal rest position of FIG. 2, suitable for enabling the passage of the boxes, to the vertical position of FIG. 13. Reaching the vertical position, the sensor 34 activates the pneumatic cylinder 35, that command the translation of the splined bushing 31, and thus of the rod 32, along the splined shaft 30 from the position illustrated in a continuous line in FIG. 23 to that illustrated in dots and lines in the same figure. The rod 32 thus straightens the rear flap 62.

Figure 15:
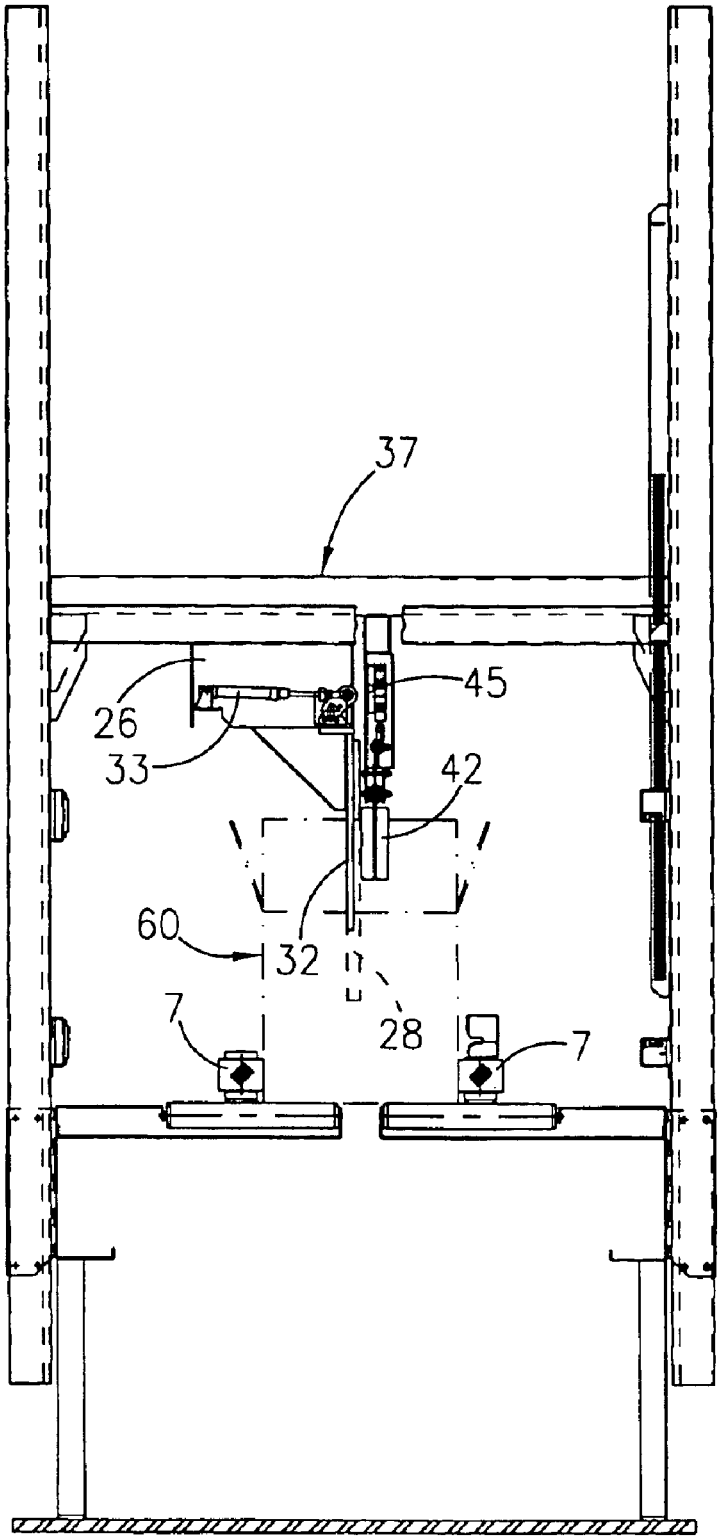
FIG. 15 shows the machine in a front view in the working position of FIG. 13.

When the translation has been made, the sensor 36 associated to the pneumatic cylinder 35 commands the activating of the pneumatic cylinder 39 for the descent of the touching group 37 for detecting the height of the box. The touching group 37 starts the descent and by means of the inclined surface 69 of the lever 42 starts folding the rear flap 62 inwards (FIGS. 14 and 15).

Figure 16:
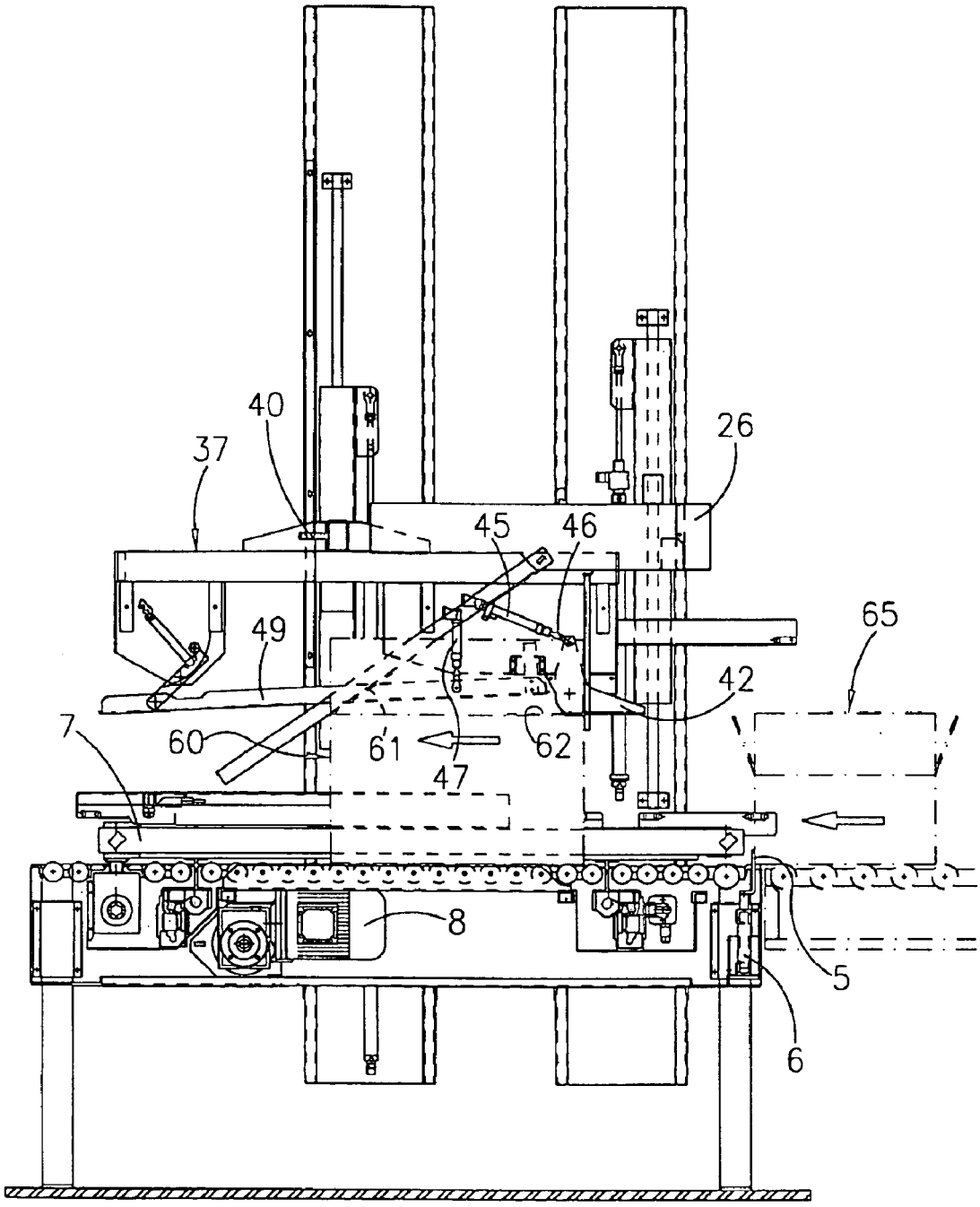
FIG. 16 shows the machine in a side view at the end of the closing movement of the rear flap of the box.
Figure 17:
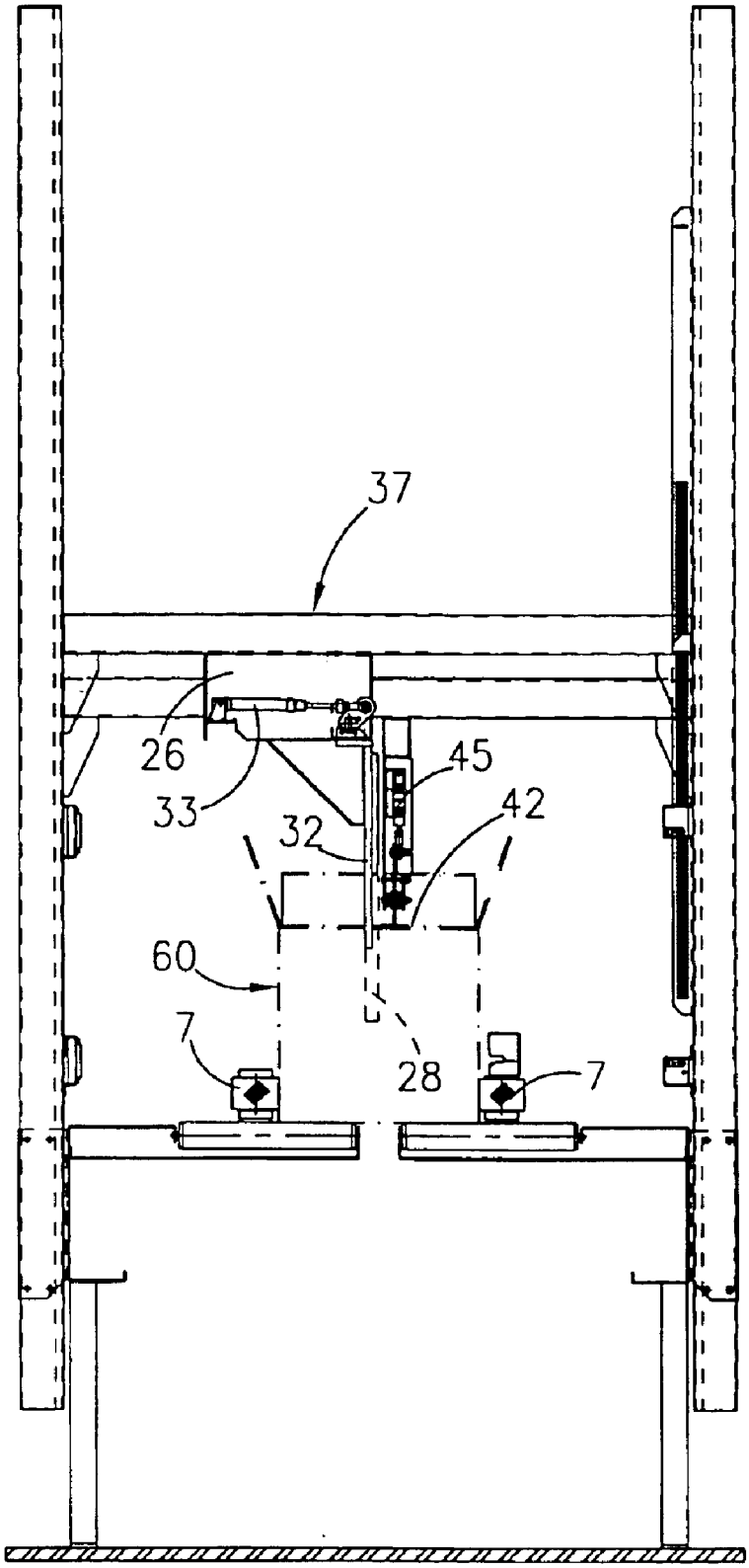
FIG. 17 shows the machine in a front view in the working position of FIG. 16.

During the descent of the touching group 37 the lever 42 continues rotating and folding the rear flap 62 and at the same time commands the return of the pneumatic cylinder 45. When the lever 42 reaches the horizontal position corresponding to the completion of the closing of the rear flap 62 of the box 60, the magnetic sensor 46 associated to the pneumatic cylinder 45 detects the complete return of the latter and consequently, in combination with the reader 40 and the holed band 41, determines the detection of the height of the box (FIGS. 16 and 17).

Figure 18:
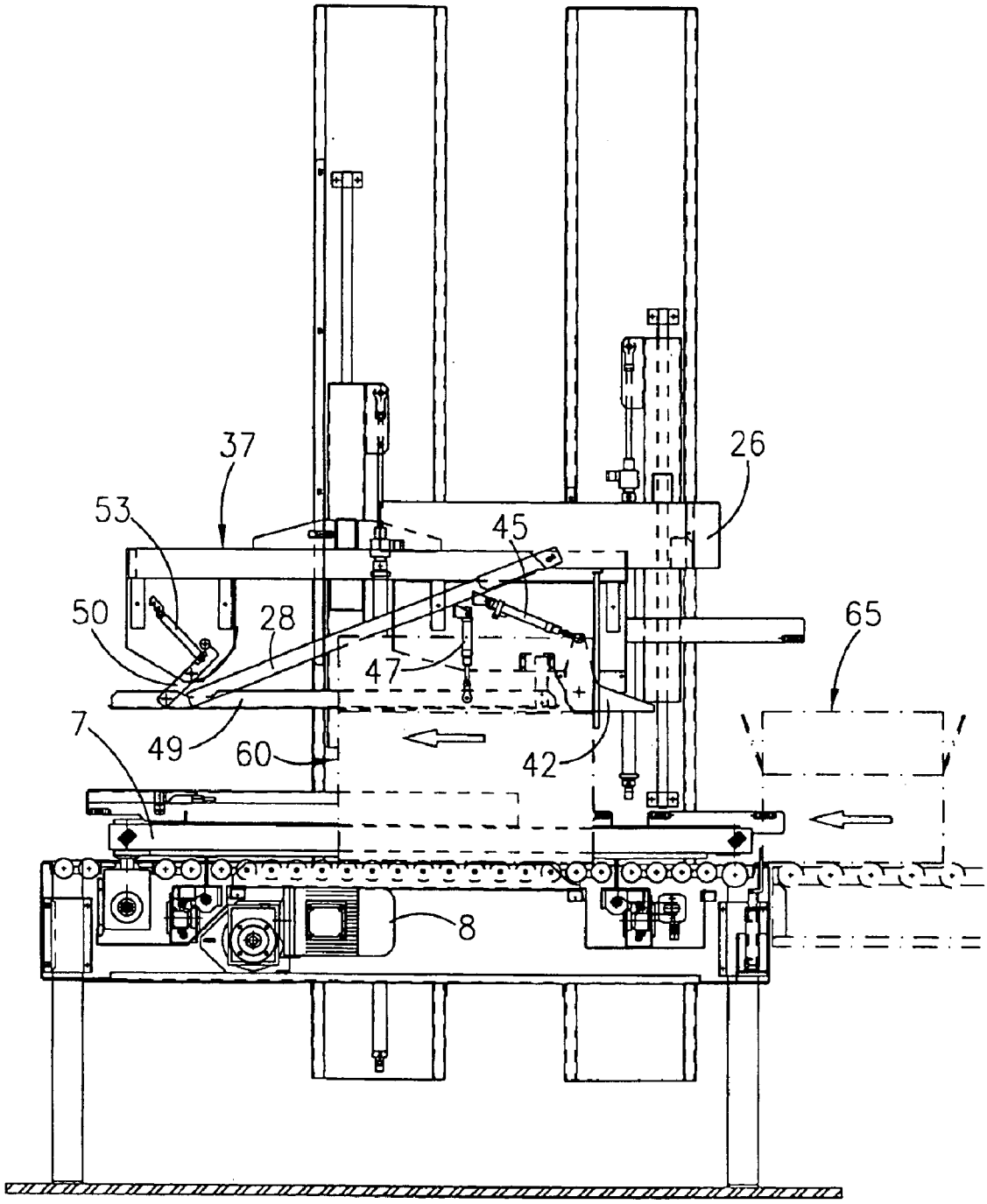
FIG. 18 shows the machine in a side view at the end of the closing movement of the front flap of the box.
Figure 19:
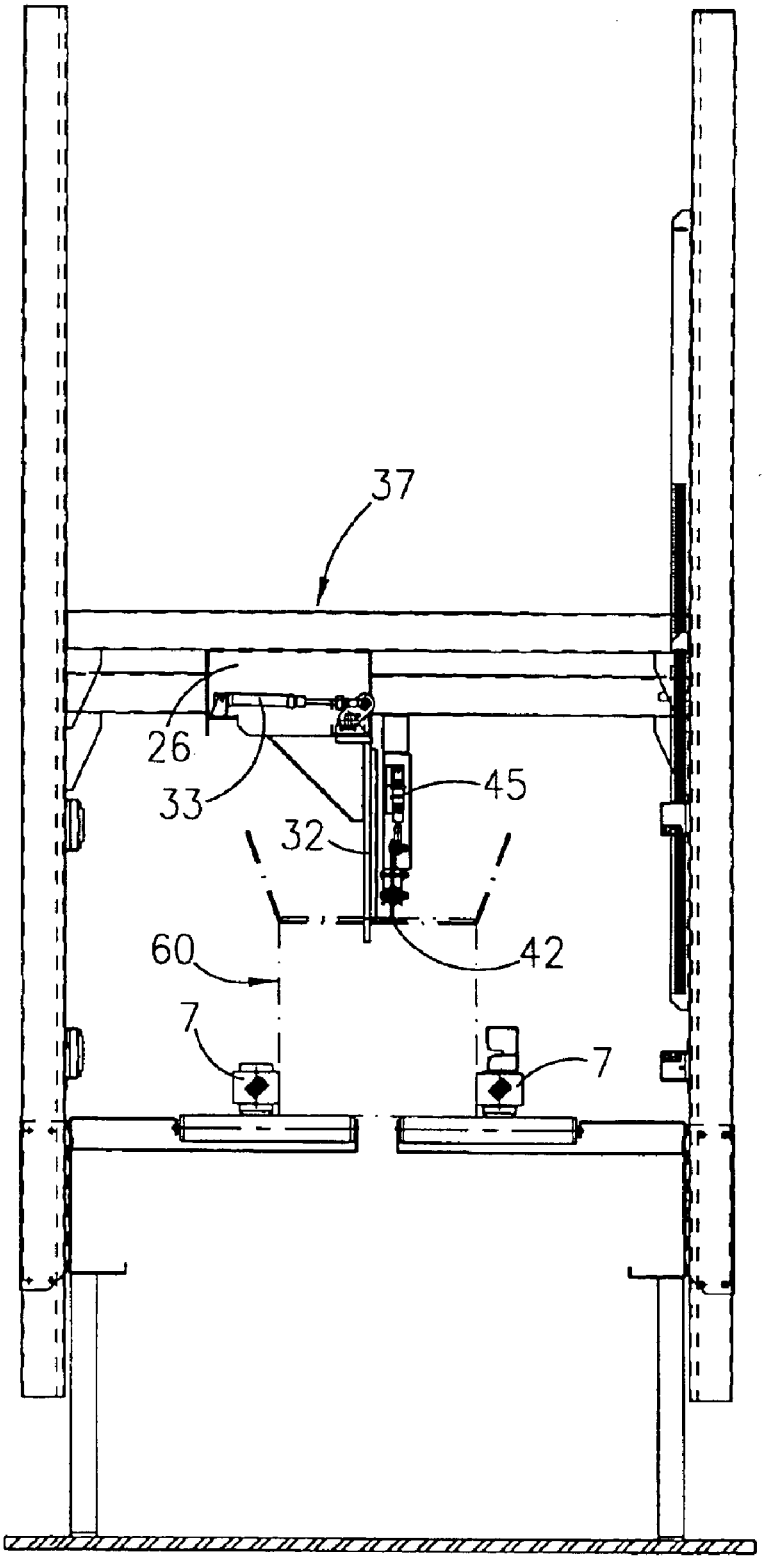
FIG. 19 shows the machine in a front view in the working position of FIG. 18.

The magnetic sensor 46 also commands the stopping of the descent of the touching group 37, by activating the brake group 66, and through the pneumatic cylinder the lowering of the rear part of the central guide 49, which positions itself horizontally and thus causes the completion of the closing of the front and rear flaps 61 and 62 (FIGS. 18 and 19). The connecting rod 50 and the spring 53 make the guide 49 tilting so as to also permit the passage of any over-filled boxes. The magnetic sensor 46 also commands the complete rotation of the rod 28 for folding the front flap 61 so as to disengage it from the box, the repositioning of the rod 32 for folding the rear flap 62 and the restart of the motor 8 and of the belts 7 for starting the box 60 again. In this phase, by means of the notch reader 40 and the relative holed band 41, the positioning of the touching group 37 is detected, definitively, and consequently the height of the box 60 to transmit to the successive station, that provides for the closing of the side flaps 67 of the box 60 and the application of the sealing tape at the top of the box.

The whole set-up then returns to the initial position of FIG. 1. To prevent useless excursions of the trolley 26, and therefore increase the productivity of the machine, the positioning of the trolley 26 comes about with the following logics:

photocell 11 activated: box present at machine input;

photocell 22 activated: the box in input has a height exceeding that of the position of the trolley 26, for which the latter rises until the photocell 22 is deactivated;

photocell 22 deactivated: the box in input has a lower height than that of the position of the trolley 26, for which the latter lowers until the photocell 22 is activated;

photocell 11 deactivated: no box in waiting at machine input and therefore the trolley 26 rises up to the upper limit switch. When the height of the box is detected, the cycle starts up again as has already been described.

What is claimed is:

1. Device for closing a rear flap in a self-dimensioning machine for closing upper flaps of parallelepiped boxes, said device comprising a base with support surface for the boxes, a couple of drive belts placed at two opposite sides of said support surface that can be motorized and that can be brought close to each other to make a drive engagement with opposite sides of the boxes to drive the boxes along a feed direction, a head assembly movably arranged above said support surface, that carries closing devices for closing the front, rear and side flaps of the boxes and can be commanded to descend from a rest position to engage the closing devices with the upper flaps of the boxes and provide for closing the boxes, and height detecting means for detecting a height of the boxes, said head assembly comprises a vertically movable head and a vertically mobile touching group that are separately commanded to descend in succession towards said support surface up to respective positions depending on the height of the box detected by said height detecting means, and said closing devices comprise a rod for straightening the rear flap, that is pivoted on said head and is automatically commanded at an end of a descent of a head to rotate from a substantially horizontal rest position to a vertical working position and to translate in said feed direction of the box to carry out the straightening of the rear flap, and a lever pivoted on said touching group downstream from said straightening rod and flexibly kept in an angular position suitable for causing a surface thereof, as a result of the descent of the touching group, to contact the straightened rear flap and thus to cause the movement of the rear flap in a closing position.

2. Device according to claim 1, wherein said lever is yieldingly kept in said angular position by a pneumatic cylinder.

3. Device according to claim 2, wherein said lever is L-shaped with a first arm forming said surface and a second arm connected to said pneumatic cylinder.

4. Device according to claim 1, wherein said rod for straightening the rear flap is provided with first drive means to cause rotation of the rod from the horizontal rest position to the vertical working position responsively to positioning of the head at a height corresponding to the height detected by said detecting means and second drive means to cause subsequent translation of the rod in the box feed direction.

5. Device according to claim 4, wherein said touching group is provided with drive means to cause its initial descent to a height just higher than the box height responsively to positioning of the head at a height corresponding to the height detected by said detecting means and a final descent to the box height responsively to the translation of the rod in the box feed direction.

* * * * *